US005313720A

United States Patent [19]

De Bortoli et al.

[11] Patent Number: 5,313,720

[45] Date of Patent: May 24, 1994

[54] SECURING DEVICE PARTICULARLY FOR SKI BOOTS

[75] Inventors: Giuseppe De Bortoli, Montebelluna; Claudio Zorzi, Paderno Di Ponzano; Luca Gallina, Caerano S. Marco, all of Italy

[73] Assignee: Nordica S.p.A., Montebelluna, Italy

[21] Appl. No.: 909,495

[22] Filed: Jul. 6, 1992

[30] Foreign Application Priority Data

Jul. 22, 1991 [IT] Italy ..... TV91A000074

[51] Int. Cl.[5] ..... A43B 5/04

[52] U.S. Cl. ..... 36/117; 36/119

[58] Field of Search ..... 36/117, 118, 119, 120, 36/121

[56] References Cited

U.S. PATENT DOCUMENTS

| | | | |
|---|---|---|---|
| 4,593,483 | 6/1986 | Paris | 36/119 |
| 4,620,379 | 11/1986 | Sartor | 36/119 |
| 4,706,393 | 12/1987 | Marxer | 36/117 |
| 4,748,751 | 6/1988 | Sartor | 36/119 |
| 4,823,485 | 4/1989 | Kemmer | 36/119 |
| 4,825,566 | 5/1989 | Sartor | 36/119 |
| 4,885,850 | 12/1989 | Sartor et al. | 36/119 |
| 4,908,965 | 3/1990 | Iwama | 36/121 |
| 4,916,834 | 4/1990 | Baggio et al. | 36/120 |
| 4,984,375 | 1/1991 | Bonnet | 36/119 |
| 5,003,711 | 4/1991 | Nerrinck et al. | 36/120 |

FOREIGN PATENT DOCUMENTS

| | | |
|---|---|---|
| 0164625 | 12/1985 | European Pat. Off. . |
| 0240967 | 10/1987 | European Pat. Off. . |
| 0254143 | 1/1988 | European Pat. Off. . |
| 0272643 | 6/1988 | European Pat. Off. . |
| 0328098 | 8/1989 | European Pat. Off. . |
| 1802710 | 5/1970 | Fed. Rep. of Germany . |

*Primary Examiner*—Paul T. Sewell
*Assistant Examiner*—M. D. Patterson
*Attorney, Agent, or Firm*—Guido Modiano; Albert Josif

[57] ABSTRACT

A securing device for ski boots, including a lever associated laterally to a ski boot and provided with a cylinder for adjusting the tension of a cable which is preferably associable with a shell at its ends and externally embraces a presser and a flap. The device allows to achieve an optimum securing for optimally retaining the foot both at the instep and at the heel.

3 Claims, 2 Drawing Sheets

SECURING DEVICE PARTICULARLY FOR SKI BOOTS

BACKGROUND OF THE INVENTION

The present invention relates to a securing device particularly for ski boots.

Securing devices are generally used in ski boots for tightening the foot instep and heel regions.

The problem of these known devices is substantially that of obtaining both an optimum securing of the foot and a rapid release thereof; these devices must also be able to take-up a large amount of cable.

As a partial solution to this problem, the U.S. Pat. No. 4,620,371 granted Nov. 4, 1986, discloses a ski boot with foot securing device including a foot instep presser arranged inside a shell. The securing device is constituted by a cable which is fixed to a traction element at one end, wraps around a presser, embraces the heel region and is connected to a fixed point on said boot at its end.

In said securing device, the traction element is constituted by a winder of a cable which in turn embraces the foot instep and the heel of the user; the use of said winder allows to rewind and thus apply tension to a considerable amount of cable.

Although this securing device is undoubtedly-valid, it has some problems: first of all, the winder is expensive because of high production costs; secondly, it is very bulky and has protruding elements which can thus be subjected to shocks or breakages.

This winder furthermore does not allow to store the degree of tension applied to the cable.

SUMMARY OF THE INVENTION

The aim of the present invention is to eliminate the problems described above in known types by providing a device which allows to optimally secure the foot instep and heel of the skier, taking up a considerable amount of cable.

Within the scope of the above aim, another important object is to provide a device which allows the user to restore the optimum securing conditions whenever he wishes.

Another important object is to provide a device which allows to store the degree of closure.

Another important object is to provide a device which is extremely easy to operate.

Another important object is to provide a device which is structurally simple, easy to industrialize, reliable and safe in use and has low manufacturing costs and reduced dimensions.

This aim, these objects and others which will become apparent hereinafter are achieved by a securing device particularly for ski boots, constituted by at least one quarter articulated to a shell, said shell comprising a rear flap and an internal presser in the foot instep region, characterized in that it comprises at least one lever associated laterally to said ski boot, said lever being provided with means for adjusting the degree of tension of at least one traction element, said traction element being associated with either one of said shell and said quarter, at its ends, and externally embracing said presser and said flap.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figure 2:
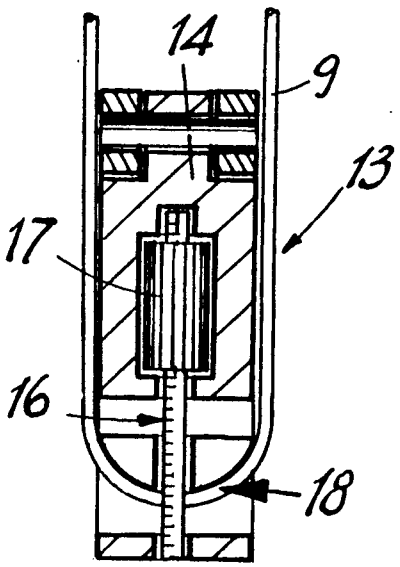
FIG. 2 is a sectional view of the securing lever, taken along a longitudinal median plane.
Figure 1:
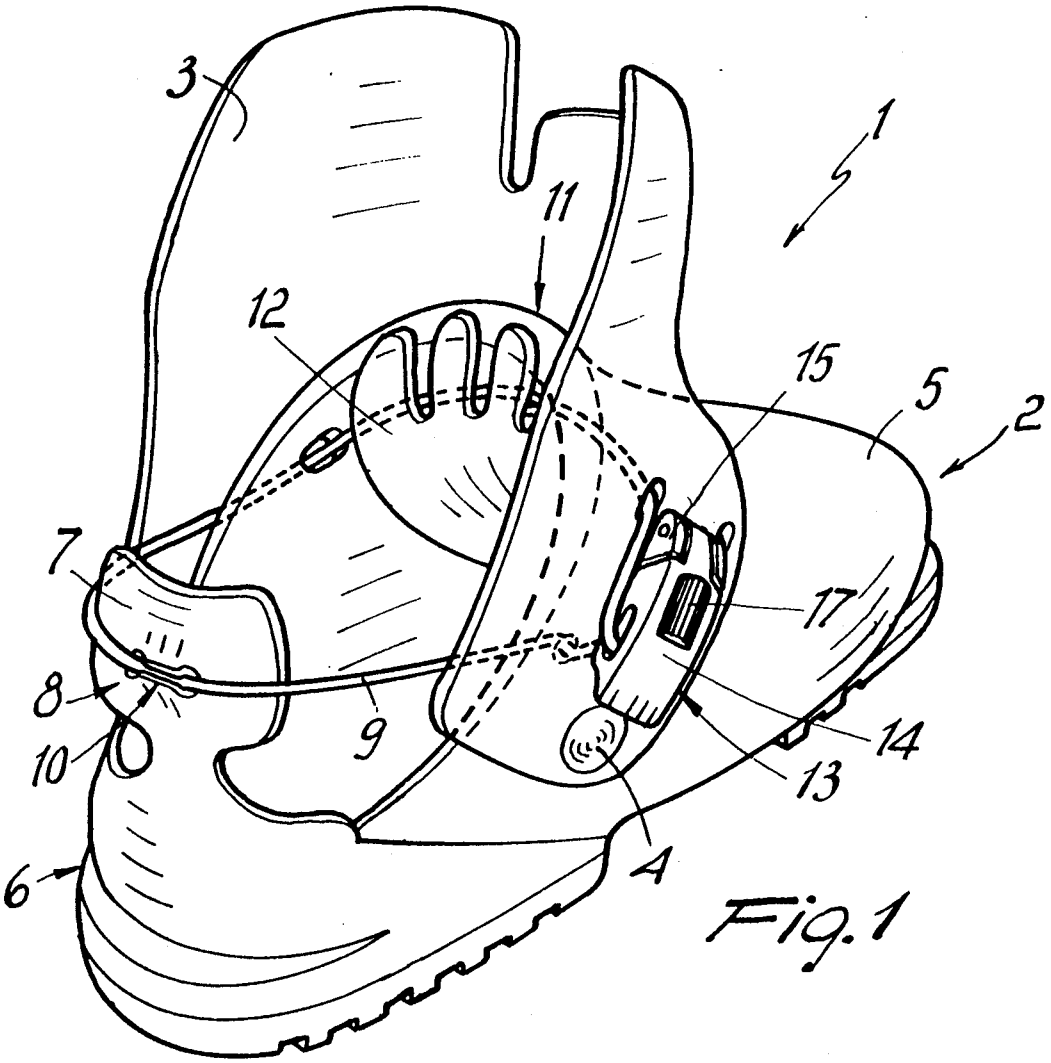
FIG. 1 is a rear perspective view of a securing device.
Figure 3:
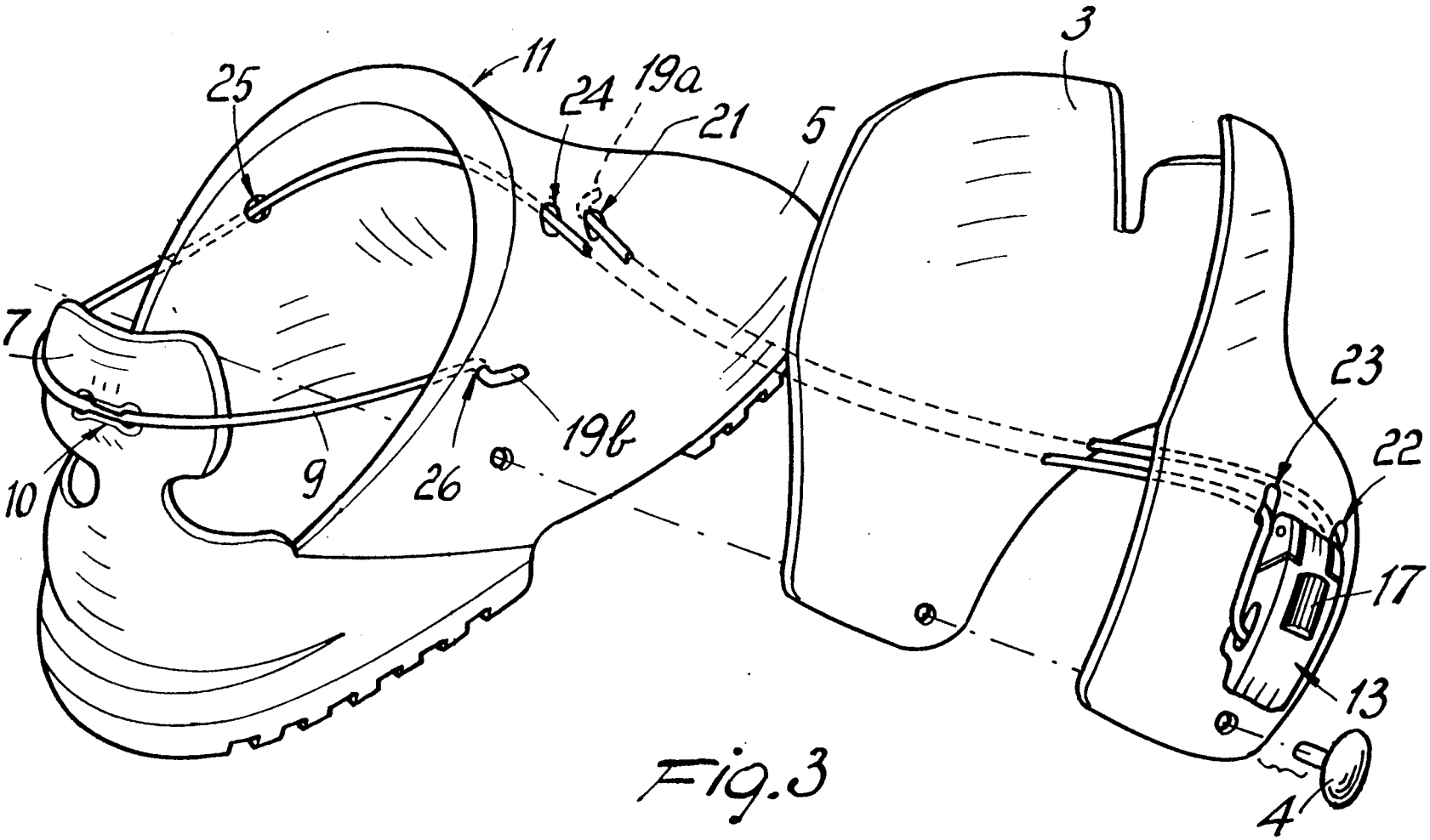
FIG. 3 is an exploded perspective view of the securing device.

With reference to the above figures, the securing device, generally designated by the reference numeral 1, is particularly usable for a ski boot, generally designated by the reference numeral 2, constituted by a front quarter 3 which is articulated to a shell 5 by means of adapted studs 4. The boot also has a rear quarter which is not illustrated in the drawings for clarity.

The shell comprises, at the heel region 6, a flap 7 which protrudes therefrom and is flexible toward the tip of the boot; a guiding element for a tension application element, such as a cable 9, is defined at the rear surface 8 of said flap and transversely thereto.

Said guiding element is advantageously constituted by a seat 10 which is suitable for accommodating said cable 9 by snap-together insertion.

A presser 12 can furthermore be arranged inside the shell 5 at the foot instep region 11.

At least one lever 13 is associated laterally to the boot, preferably at the front quarter 3, and is provided with means for adjusting the degree of tension of at least one cable 9.

Said lever thus comprises a body 14 which is freely pivoted, at one end, to a pair of shoulders 15 which are associated with the front quarter 3; a pin 16 is longitudinally associated within said body, and a knurled cylinder 17 interacts therewith and can be accessed by the skier.

Said knurled cylinder 17 allows, upon activation on the part of the skier, to move a semicircular guide 18 along the pivot 16; said guide can perform a movement which is longitudinal to the body 14 and leads, in the direction opposite to the shoulders 15, to the application of tension to the cable 9.

The cable 9 can slide freely at said guide 18.

Said cable has, at its terminal ends, a first wing and a second wing, designated by the numerals **19*a* and 19*b*, which are S-shaped; the first wing 19*a* is removably arranged within a first hole 21 which is defined laterally to said shell 5. The first wing 19*a* can also be arranged in a second hole 22, formed on the side of the front quarter 3**.

The cable 9 starts from first hole 21, or from second hole 22, and affects the lever 13 by passing at the guide 18 and then passes within a third hole 23 and a fourth hole 24 defined on said front quarter and on said shell.

The cable 9 is then passed within the interspace defined between the presser and the shell and then exits from said shell through a fifth hole 25.

The cable 9 subsequently externally embraces said flap 7, engaging in the seat 10, and is then associated, at its free end, with the shell 5 again by virtue of the insertion of the second wing **19*b* within a sixth hole 16 defined laterally to the shell 5**.

The use of the device is as follows: once the foot has been inserted in the boot, the user simply has to act on the lever and on the means for adjusting the degree of tension of the cable 9 in order to achieve the optimum securing of said foot, since the cable embraces the region of the foot instep and of the heel.

By virtue of the particular arrangement of the cable inside the shell and the front quarter and of the application of the lever laterally to said front quarter, by acting on said lever the skier can take up a considerable amount of cable and store, when said lever is opened, the degree of tension which can be applied to said cable.

It has thus been observed that the invention has achieved the above described aim and objects, a device having been provided which allows to achieve an optimum securing of both the foot instep and the heel, all by means of a device which is very simple and easy to activate as well as extremely economical.

It should also be noted that it is possible to store the degree of tension of the cable by using a lever having very small dimensions and slight protrusions from the front quarter.

The device according to the invention is susceptible to numerous modifications and variations, all of which are within the scope of the same inventive concept.

Thus, for example, the lever may be connected to the boot in a non-rigid manner and thus be, for example, of the type disclosed in the U.S. Pat. No. 4,934,074 granted Jun. 19, 1990 by the same Assignee.

The cables may also be fixed by means of rivets and may be rigidly associated with the shell and/or with the quarter.

The materials and dimensions which constitute the individual components of the device may also naturally be the most pertinent according to the specific requirements.

We claim:

1. A securing device in combination with a boot comprising a shell and at least one quarter connected to said shell, the securing device comprising a rear flap at a heel region of the boot and an internal foot presser at a foot instep region of the boot, the securing device further comprising a traction element and a lever device, said lever device comprising a lever body with a longitudinal axis and an end pivotally connected to said boot, said lever device further comprising a guide element arranged away from said end thereof, said traction element comprising a first end portion, a second end portion, and a middle portion extending between said end portions, said first end portion being arranged at a first lateral portion of said boot, said middle portion extending from said first portion and engaging over said rear flap, said middle portion further extending from said rear flap and adjacent to a second lateral portion of said boot opposite to said first lateral portion, said middle portion further extending from said second lateral portion and engaging over said internal foot presser and extending back to said first lateral portion of the boot at which said second end portion of the traction element is arranged, thereby said traction element extending in a substantially 360 degree extension from said first lateral portion over said rear flap and past said second lateral portion and over said internal foot instep presser and back to said first lateral portion, said end of said lever body of said lever device being pivotally connected to said boot at said first lateral portion thereof, one of said end portions of said traction element being connected to said first lateral portion, said middle portion of said traction element extending from said one of said end portions of said traction element and being slidably guided over said guide element of said lever device and further slidably guided through at least one hole in said lateral portion, and the other of said end portions of said traction element being connected to said first lateral portion of said ski boot.

2. The combination of claim 1, wherein said rear flap is part of said shell and said internal foot instep presser is arranged inside said shell.

3. The combination of claim 1, wherein said guide element is adjustably movable on said lever body in a direction of said longitudinal axis.

* * * * *